US009583899B2

(12) United States Patent
Heiskanen

(10) Patent No.: US 9,583,899 B2
(45) Date of Patent: Feb. 28, 2017

(54) APPARATUS FOR RECEIVING A SIGNAL PLUG

(71) Applicant: Microsoft Technology Licensing, LLC, Redmond, WA (US)

(72) Inventor: Juuso Heiskanen, Kaarina (FI)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 27 days.

(21) Appl. No.: 14/694,538

(22) Filed: Apr. 23, 2015

(65) Prior Publication Data

US 2016/0315429 A1 Oct. 27, 2016

(51) Int. Cl.

| | |
|---|---|
| ***H01R 24/04*** | (2006.01) |
| ***H01R 24/58*** | (2011.01) |
| ***H01H 1/38*** | (2006.01) |
| ***H01R 13/703*** | (2006.01) |
| ***H01R 43/16*** | (2006.01) |
| *H01R 107/00* | (2006.01) |

(52) U.S. Cl.

CPC ..... *H01R 24/58* (2013.01); *H01H 1/38* (2013.01); *H01R 13/7032* (2013.01); *H01R 43/16* (2013.01); *H01R 2107/00* (2013.01)

(58) Field of Classification Search

USPC ..... 439/668, 276, 936, 733.1

See application file for complete search history.

(56) References Cited

U.S. PATENT DOCUMENTS

| | | | | |
|---|---|---|---|---|
| 3,383,481 | A * | 5/1968 | Bailey | H01R 24/58 200/51.1 |
| 4,978,310 | A * | 12/1990 | Shichida | H01R 13/7035 200/51.1 |
| 6,077,126 | A * | 6/2000 | Peng | H01R 24/58 439/188 |
| 6,168,448 | B1 | 1/2001 | Chang | |
| 6,220,899 | B1 | 4/2001 | Suzuki | |
| 6,690,801 | B2 | 2/2004 | Yeh | |
| 7,387,543 | B1 * | 6/2008 | Wu | H01R 24/58 439/668 |

(Continued)

FOREIGN PATENT DOCUMENTS

| | | |
|---|---|---|
| CN | 202585916 U | 12/2012 |
| EP | 0998178 A1 | 5/2000 |

(Continued)

OTHER PUBLICATIONS

Flanagan, et al., "Commercial Telephone Plugs & Jacks Four Conductor", Published on: Dec. 28, 2013, Available at: http://www.amphenol-aerospace.com/pdf/Nexus_Catalog.pdf.

(Continued)

*Primary Examiner* — Tho D Ta

(74) *Attorney, Agent, or Firm* — Qudus Olaniran; Judy Yee; Micky Minhas

(57) ABSTRACT

An apparatus is described. In an embodiment, the apparatus comprises a housing, wherein the housing comprises a circular cavity; and at least two longitudinal grooves placed in separate corner portions of the housing and around the circular cavity. Further, the apparatus comprises an electric contact associated with each longitudinal groove.

20 Claims, 9 Drawing Sheets

(56) References Cited

U.S. PATENT DOCUMENTS

| | | | | |
|---|---|---|---|---|
| 7,503,807 | B2 * | 3/2009 | Martin | H01R 13/502 439/638 |
| 7,892,041 | B2 | 2/2011 | Myers et al. | |
| 7,901,251 | B1 | 3/2011 | Chen | |
| 7,927,108 | B2 * | 4/2011 | Gong | H01R 13/7031 439/63 |
| 8,079,880 | B2 * | 12/2011 | Lin | H01R 13/631 439/668 |
| 8,123,569 | B2 | 2/2012 | Little et al. | |
| 8,696,391 | B2 | 4/2014 | Ladouceur et al. | |
| 8,715,011 | B2 | 5/2014 | Chen et al. | |
| 9,017,088 | B2 * | 4/2015 | Endo | H01R 9/00 439/276 |
| 2003/0153213 | A1 | 8/2003 | Siddiqui et al. | |
| 2007/0218774 | A1 | 9/2007 | Han et al. | |
| 2007/0232149 | A1 | 10/2007 | Tai | |
| 2008/0032562 | A1 | 2/2008 | McHugh et al. | |
| 2010/0240259 | A1 | 9/2010 | Murphy et al. | |
| 2012/0052705 | A1 | 3/2012 | Su et al. | |
| 2013/0244498 | A1 | 9/2013 | Zhang | |

FOREIGN PATENT DOCUMENTS

| | | | |
|---|---|---|---|
| EP | 2341584 | A1 | 7/2011 |
| WO | 2013080443 | A1 | 6/2013 |

OTHER PUBLICATIONS

"International Search Report & Written Opinion issued in PCT Application No. PCT/US2016/026076", Mailed Date: Jul. 1, 2016, 15 Pages.

* cited by examiner

APPARATUS FOR RECEIVING A SIGNAL PLUG

BACKGROUND

Many electronic devices such as cellular phones, MP3 players and miscellaneous portable audio devices require the use of external audio earphones, head phones or a head set in order to hear media sound. A consumer may need a microphone in order to talk to a caller on a mobile phone, when, for example, the head set is connected to the mobile phone.

SUMMARY

This Summary is provided to introduce a selection of concepts in a simplified form that are further described below in the Detailed Description. This summary is not intended to identify key features or essential features of the claimed subject matter, nor is it intended to be used to limit the scope of the claimed subject matter.

The apparatus comprises a housing, wherein the housing comprises a circular cavity; and at least two longitudinal grooves placed in separate corner portions of the housing and around the circular cavity. Further, the apparatus comprises an electric contact associated with each longitudinal groove of the at least two longitudinal grooves.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1A:
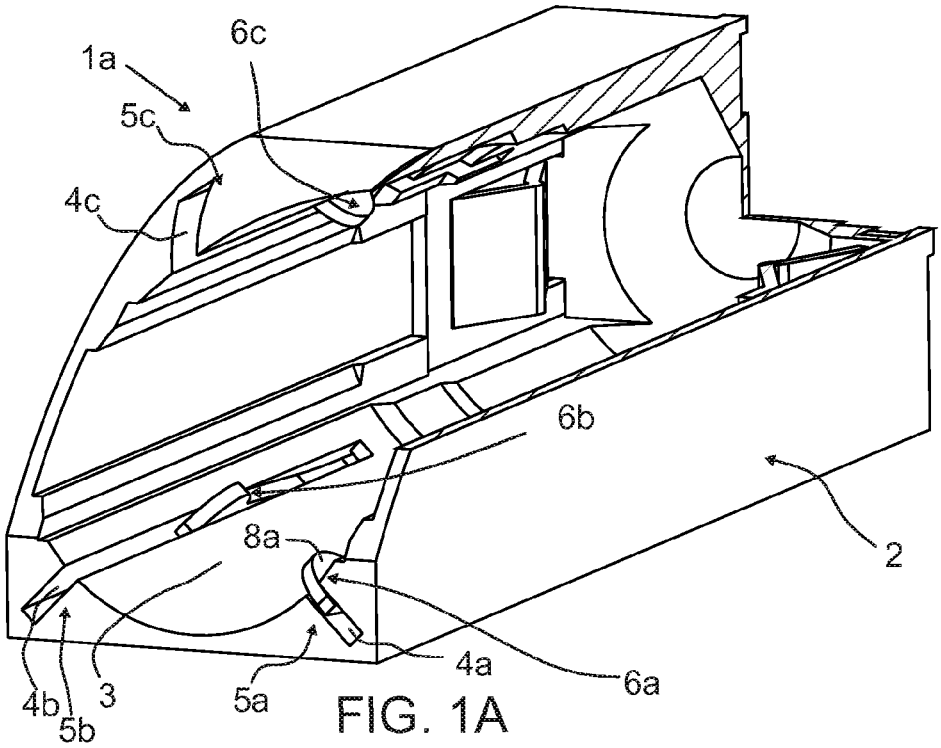
FIG. 1A is an example illustration of an apparatus, where a housing of the apparatus has a partial cut-out.

The detailed description provided below in connection with the appended drawings is intended as a description of the present examples and is not intended to represent the only forms in which the present example may be constructed or utilized. However, the same or equivalent functions and sequences may be accomplished by different examples.

Usually a circular cavity is provided in audio devices for connecting a signal plug, such as an audio/video plug, in order to hear audio sound and/or, for example, provide a connection for transmitting video signals. In electronics, a signal plug is typically used for analog signals, primarily audio. It is cylindrical in shape, typically with two, three, four or five contacts. The signal plug, being a male connector, can be connected to a jack, which is a female connector. The jack may have one electric contact corresponding to each contact of the signal plug. The electric contact functions as a spring which presses towards a contact of the signal plug. This spring function is important because good connection is needed between the electric contact of the jack and the contact of the signal plug. One example of a jack is an audio/video jack, which is often called an AV jack.

Each contact comprises one contact surface for transmitting a signal to the signal plug or vice versa. For example, the contacts may comprise "left channel", "right channel", "ground", "microphone" and "switch". If only mono audio is needed, only two or three contacts are needed. The ground eliminates or at least alleviates the noise in the audio signal. The switch may give feedback information to program software of a device comprising an audio/video jack. The program software may switch the audio signal from the device speakers into the external head set, connected to the audio/video jack. The switch may also launch, or control the functions of, a media player when the signal plug is connected.

Electric contacts may be manufactured by metal stamping. Usually in metal stamping the manufacturer uses high tonnage presses and stamping dies to forge sheets of metal into complete or semi-complete parts. Precision metal stamping improves the speed and accuracy of complex stamping applications by allowing the stamping, folding, drawing, or piercing of a product in a single operation or a series of operations. The operations may be automated.

There are three types of signal plugs, such as audio/video plugs, that may be most commonly used in electronic equipment such as portable devices. The outside diameter of a "sleeve" plug is ¼ inch (6.35 mm). This 6.35 mm plug is most commonly used, for example, in electric guitars, loudspeakers, microphones and line-level audio equipment. In bigger equipment, the size of the signal plug is not necessarily a critical feature. A "mini" plug has a diameter of 3.5 mm (approx. ⅛ inch) and a "sub-mini" plug has a diameter of 2.5 mm (approx. 3/32 inch). The 3.5 mm plug is maybe the most widely used, for example, in mobile devices. An outer end of the signal plug is usually coned. This feature enables the locking of the signal plug inside the jack by means of the coned part.

Some users desire that a device having a signal plug is waterproof. In this instance, a housing of the apparatus comprising a cavity for the signal plug may also have to be waterproof. When a slot or a groove is structured in the housing for an electric contact, adequate wall thickness must be left between the slot or groove and the housing. This wall thickness is needed for the mechanical strength, and generally a uniform wall is needed in waterproof applications. Needs from consumers for smaller and lighter electronic products and needs from the electronic industry for developing new and smaller devices lead to miniaturization. Even minor size reduction of the housing may be a key factor when manufacturing the apparatus. In some devices, the electric contacts are placed on the same side of the housing or on two sides of the housing. This leads to an increase in the width of the housing on the side where the electric contacts are placed.

FIG. 1A is an example illustration of an apparatus 1*a*, where a housing 2 of the apparatus 1*a* has a partial cut-out. The apparatus 1*a* in FIG. 1A is illustrated with a partial cut-out in order to see the parts inside the apparatus 1*a*. The housing 2 comprises a circular cavity 3 and at least two longitudinal grooves 4*a*, 4*b*, 4*c* placed in separate corner portions 5*a*, 5*b*, 5*c* of the housing 2 and around the circular cavity 3. Further, the apparatus 1*a* comprises electric contacts 6*a*, 6*b*, 6*c* associated with each longitudinal groove 4*a*, 4*b*, 4*c*. The at least two longitudinal grooves 4*a*, 4*b*, 4*c* are structured to open into the circular cavity 3. Each electric contact 6*a*, 6*b*, 6*c* is individually positioned into its associated longitudinal groove 4*a*, 4*b* 4*c*. One electric contact 6*a*, 6*b*, 6*c* is provided in each longitudinal groove 4*a*, 4*b*, 4*c*. The longitudinal grooves 4*a*, 4*b*, 4*c* maintain the electric contacts 6*a*, 6*b*, 6*c* firmly in place. The external appearance of the housing 2 and the transversal cross-section of the housing 2 are structured to be substantially rectangular.

Figure 1B:
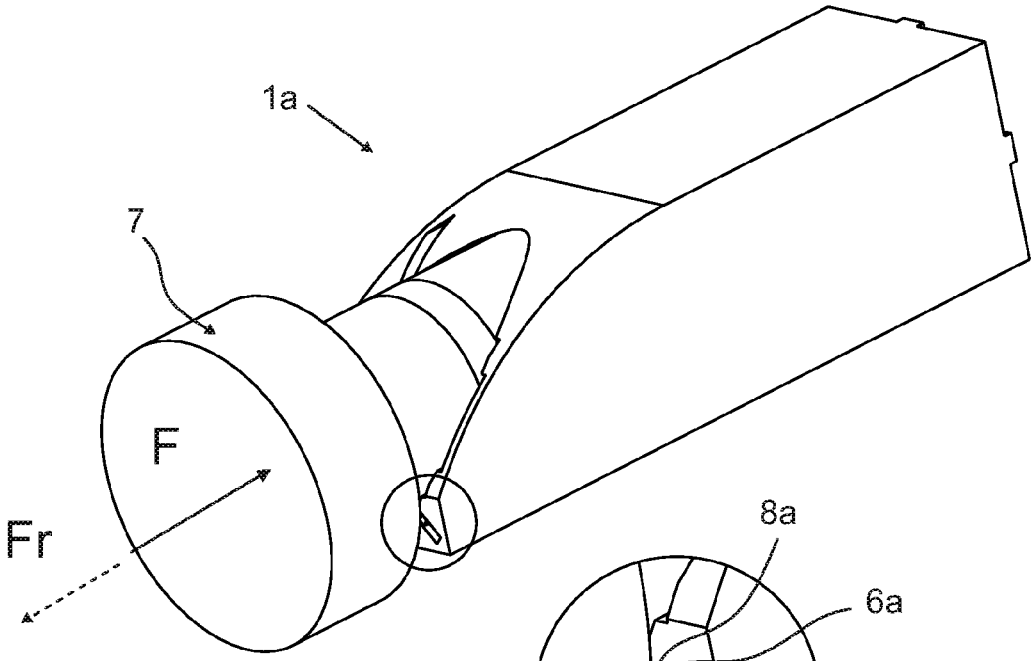
FIG. 1B is an example illustration of an apparatus, where a signal plug is inserted.

FIG. 1B is an example illustration of the apparatus 1*a* into which a signal plug 7 is inserted. The signal plug 7 is inserted into the cavity 3 and locked with a locking mechanism near a bottom of the cavity 3 by pushing the signal plug with an external force F applied by a user in the direction of the arrow. The apparatus 1*a* is structured to releasably receive the signal plug 7 within the cavity 3. The signal plug 7 can be, for example, an audio/video plug. A second external force Fr is needed, when the signal plug 7 is removed from the apparatus 1*a*. The second external force Fr applied by the user is directed naturally away from the cavity 3. The second external force Fr is illustrated with a dashed arrow. The operation of the locking mechanism is illustrated in more detail in FIGS. 2C and 3B.

Figure 1C:
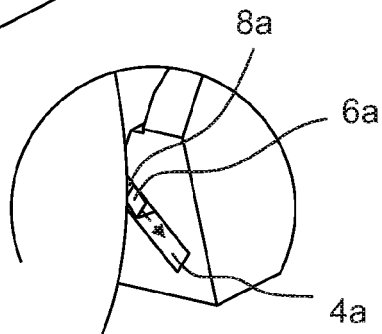
FIG. 1C is a partial enlargement illustration of an electric contact in a longitudinal groove of an apparatus.

FIG. 1C is a partial enlargement illustration of an electric contact 6*a* in a longitudinal groove 4*a*. FIG. 1C illustrates the portion indicated with a circle in FIG. 1B. The electric contact 6*a* may be structured to function as a spring which presses towards a contact surface of the signal plug 7, when the signal plug 7 is inserted into the cavity 3. When the signal plug 7 is inserted, an edge 8*a* of the electric contact 6*a* moves away from the signal plug 7 along the longitudinal groove 4*a* in the direction of the arrow while contact between the signal plug 7 and the electric contact 6*a* is maintained. As the electric contact 6*a* functions as a spring, a sufficient contact is formed between the edge 8*a* and the signal plug 7. Although FIG. 1C illustrates only one electric contact 6*a*, the apparatus 1*a* may comprise additional electric contacts having a similar edge 8*a* as the electric contact 6*a*. The connections between the electric contacts 6*a*, 6*b*, 6*c* and the signal plug 7 are illustrated in more detail in FIG. 4.

Figure 2A:
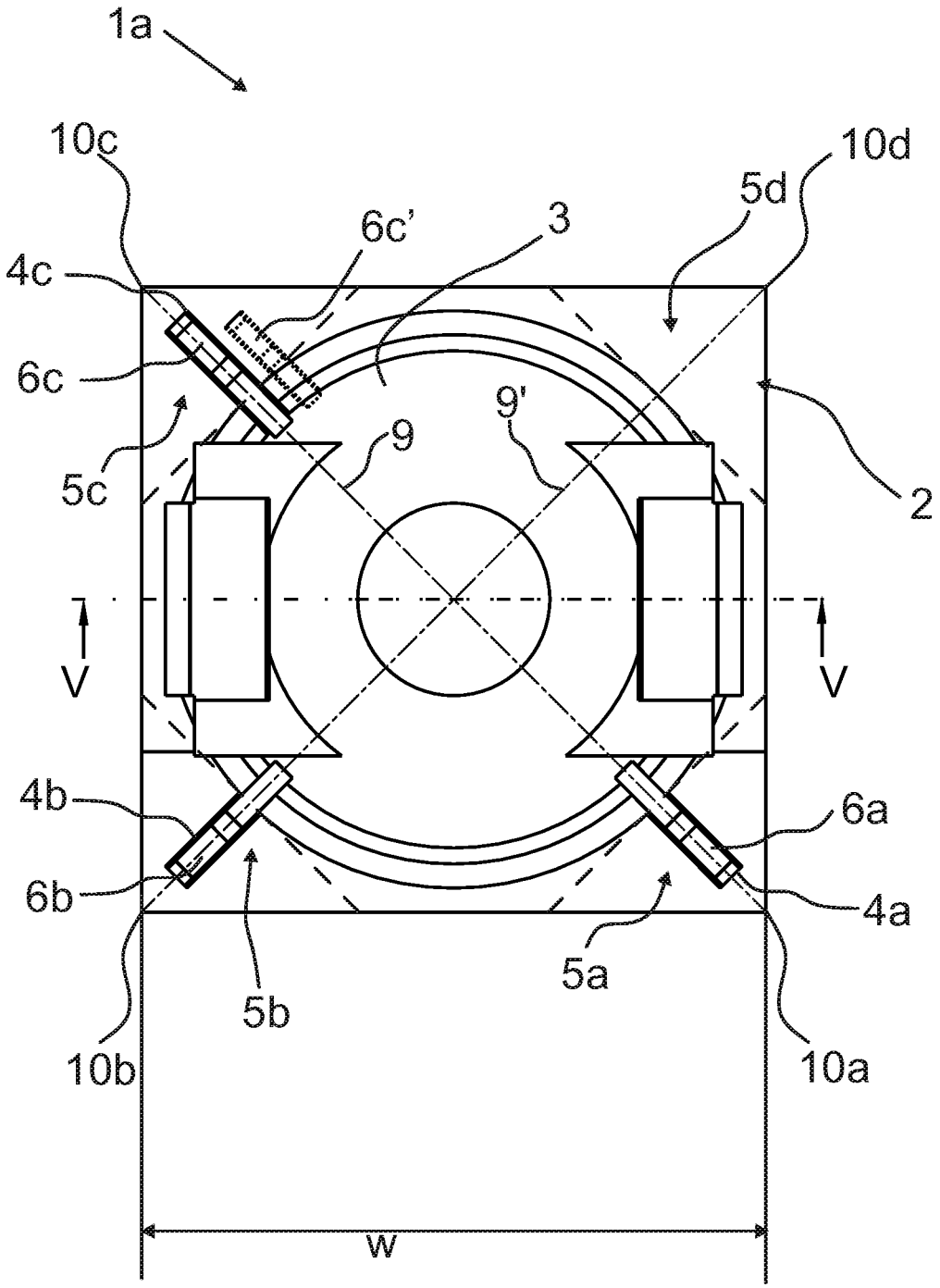
FIG. 2A is an example illustration of an apparatus from the open end direction of a cavity of the apparatus.

FIG. 2A is an example illustration of the apparatus 1*a* from the open end direction of the cavity 3 of the apparatus 1*a*. FIG. 2A illustrates an example where each longitudinal groove 4*a*, 4*b*, 4*c* is placed at least partially on the diagonal 9, 9' of the transversal cross-section of the housing 2. By placing the longitudinal grooves 4*a*, 4*b*, 4*c* and the electric contacts 6*a*, 6*b*, 6*c* in the separated corner portions 5*a*, 5*b*, 5*c*, a reduction of the width W of the housing 2 is accomplished. A compact size of the apparatus 1*a* is an advantage and is a significant factor in equipment. Further, another solution is to place the electric contact 6*c*' in immediate vicinity of the diagonal of the transversal cross-section of the housing 2. The housing 2 comprises at least two corner portions 5*a*, 5*b*, 5*c*. In FIG. 2A, the first corner portion 5*a*, the second corner portion 5*b* and the third corner portion 5*c* are utilized for the electric contacts 6*a*, 6*b*, 6*c*. An electric contact 6*c*' which is placed next to the diagonal 9, 9*a* is illustrated with a dotted line in FIG. 2A. In this solution, the size of the electric contact 6*c*' which is placed next to the diagonal 9 may have to be smaller than the third electric contact 6*c* in order to keep the sufficient wall thickness. As the largest space for the electric contacts 6*a*, 6*b*, 6*c* is near the corners 10*a*, 10*b*, 10*c*, 10*d* of the housing 2, the most preferable place is on the diagonals 9, 9'. There are separate corner portions 5*a*, 5*b*, 5*c* between the dashed lines and the corners 10*a*, 10*b*, 10*c* of the housing. In this way, the largest wall thickness is left around the longitudinal grooves 4*a*, 4*b*, 4*c*. It is also possible to implement a fourth electric contact on the upper right corner of the housing 2 (not illustrated). When there is no fourth contact, one side of the apparatus may be manufactured rounded. This may be a useful feature when good appearance is needed for an electronic apparatus comprising the apparatus 1*a*. For example, the housing 2 may be placed in to the corner of a device with a rounded edge, and rounding the fourth corner may accommodate a rounded device edge. The rounding may not be necessary if the apparatus 1*a* is not placed near a corner or a side of an electronic device comprising the apparatus 1*a*. By placing the electric contacts 6*a*, 6*b*, 6*c* in the separate corner portions 5*a*, 5*b*, 5*c* of the housing 2, effective use of space in the apparatus can be achieved. This also minimizes the width W.

Figure 2B:
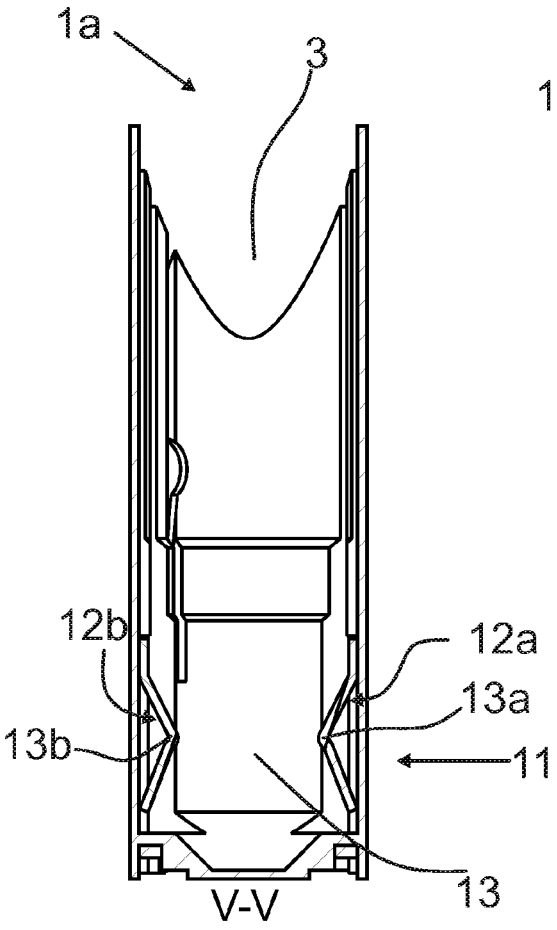
FIG. 2B is an example illustration of a locking mechanism inside an apparatus.

FIG. 2B is an example illustration of a locking mechanism 11 inside the apparatus 1*a*. FIG. 2B is a sectional view of the cut-out V-V. The locking mechanism 11 is configured to lock a signal plug 7 within the cavity 3 with at least one lock plate 12*a*, 12*b*. The locking mechanism 11 disclosed in FIG. 2B comprises two lock plates 12*a*, 12*b* opposing each other in the inner end portion 13 of the cavity 3. This locking mechanism 11 illustrated in FIG. 2B may have the switch function and therefore at least two lock plates 12*a*, 12*b* are needed in the structure of the apparatus 1*a*.

Figure 3B:
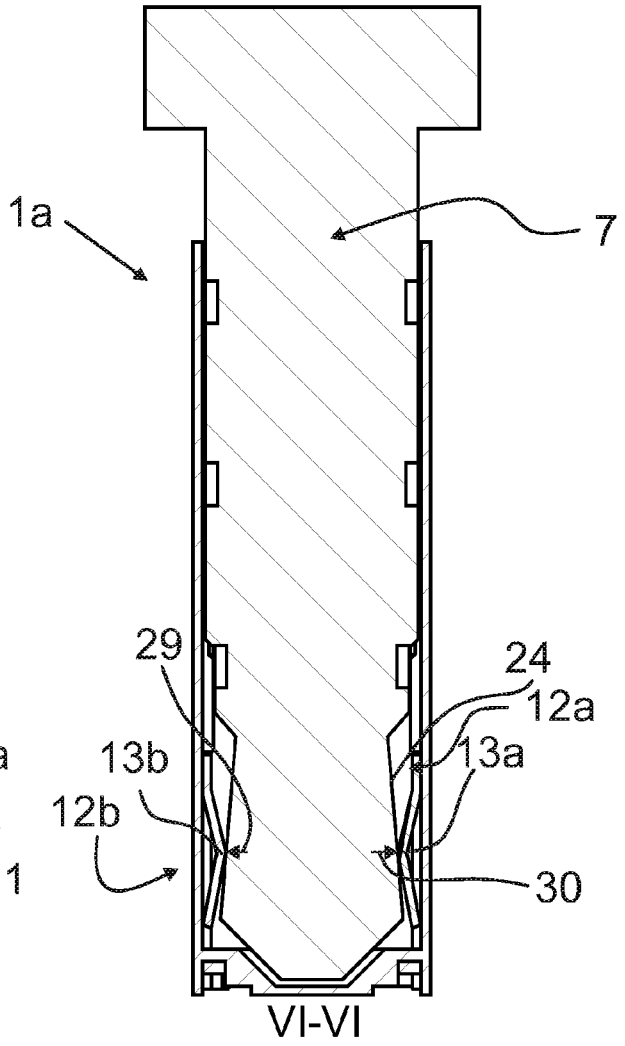
FIG. 3B is an example illustration of an apparatus, where a signal plug is connected.
Figure 3A:
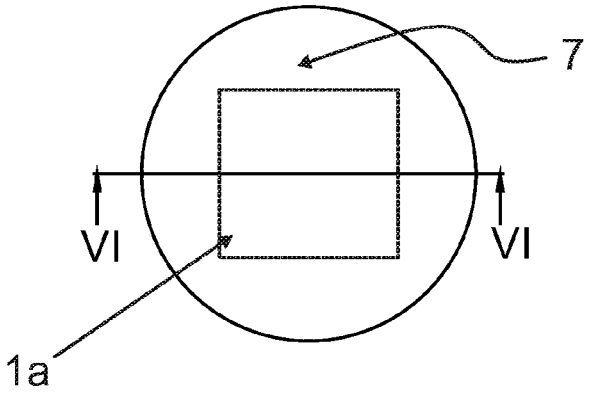
FIG. 3A is an example illustration of an apparatus, where a signal plug is connected.

FIGS. 3A and 3B are example illustrations of the apparatus 1*a*, when a signal plug 7 is connected. FIG. 3A illustrates the direction of the section view VI-VI. When comparing FIG. 2B and FIG. 3B, it can be noticed that the lock plates 12*a*, 12*b* in FIG. 3B have been bent or flattened when the signal plug 7 is pushed inside the cavity 3. This is indicated with horizontal arrows 29 and 30. Similarly to the electric contacts 6*a*, 6*b*, 6*c*, the lock plates 12*a*, 12*b* also function as springs. The lock plates 12*a*, 12*b* comprise locking portions 13*a*, 13*b*, which are configured to be compressed when a conical part 24 of the signal plug 7 presses towards the locking portions 13*a*, 13*b*. When the signal plug 7 is removed, the locking portions 13*a*, 13*b* move back to their original position due to the spring function of the lock plates 12*a*, 12*b*. The lock plates 12*a*, 12*b* may function as the "switch" which was explained earlier. The lock plates 12*a*, 12*b* may also function as a fourth electric contact at the same time.

Figure 3C:
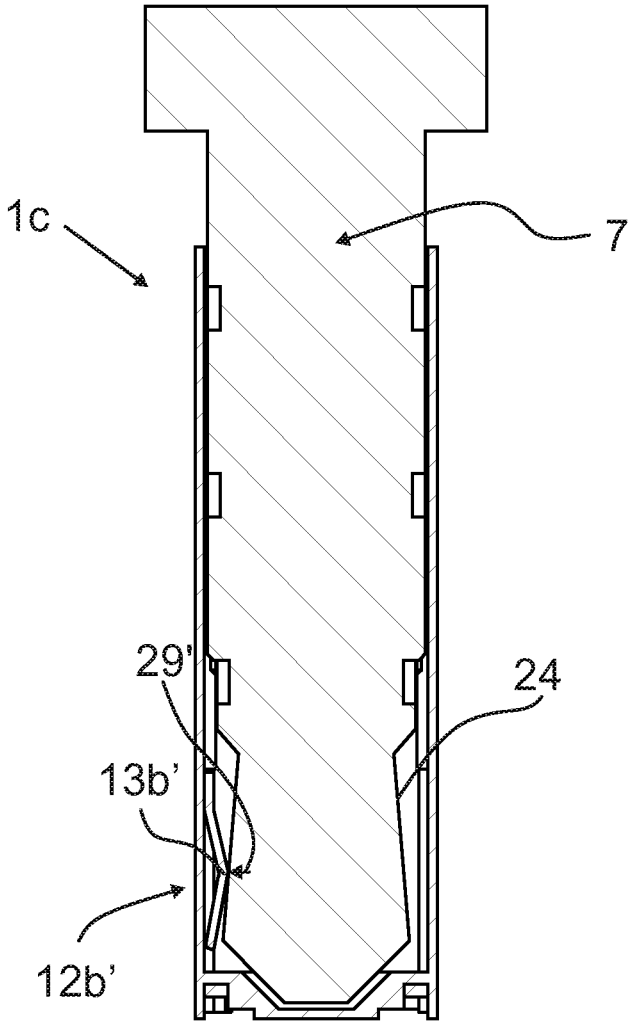
FIG. 3C is an example illustration of an apparatus, when a signal plug is connected.
Figure 4:
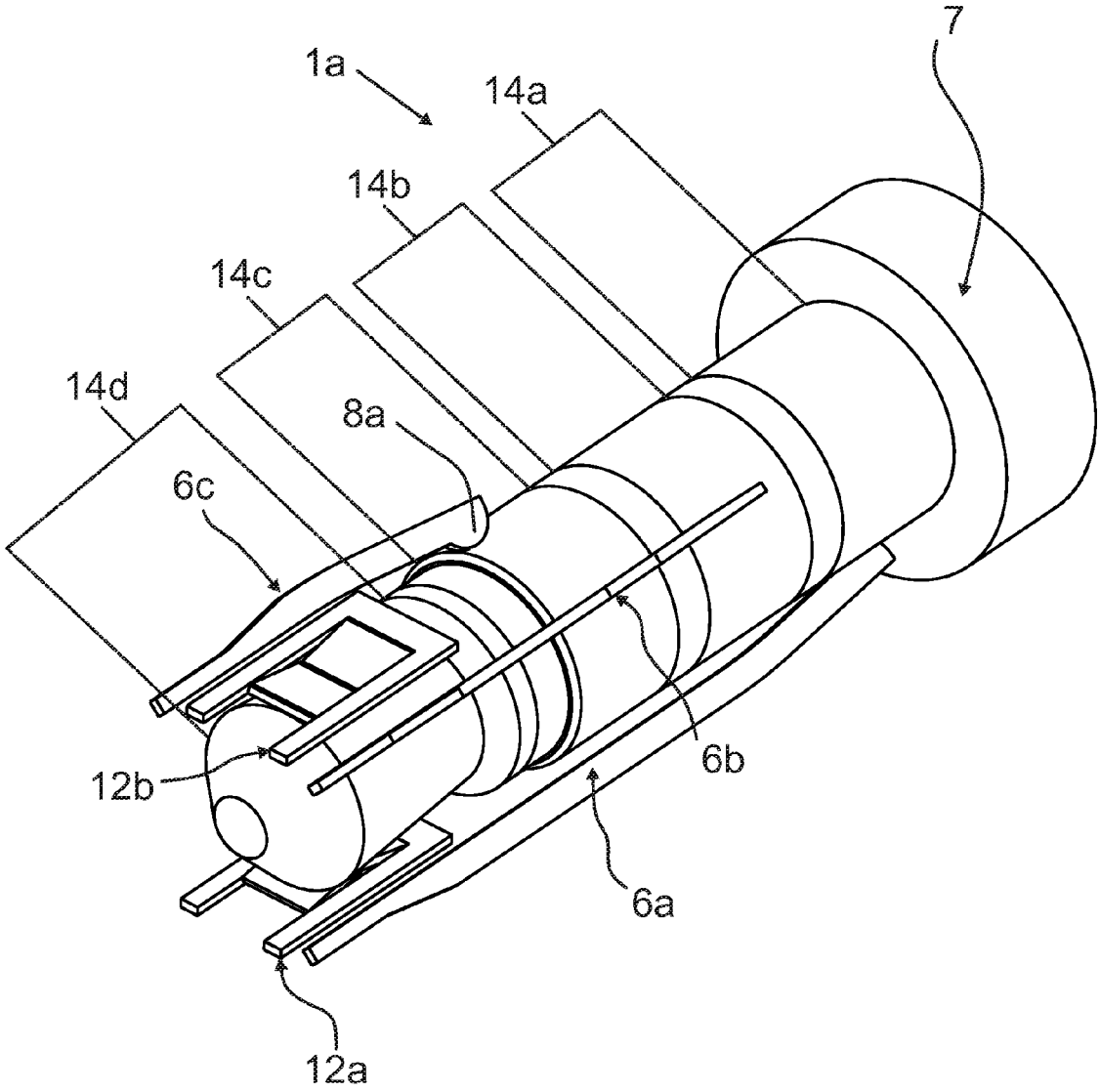
FIG. 4 is an example illustration of an apparatus without a housing with a signal plug inserted.

FIG. 3C is an example illustration of the apparatus 1*c*, when a signal plug 7 is connected. The apparatus 1*c* in FIG. 3C is similar to the apparatus 1*a* in FIG. 3B with the exception that only one lock plate 12*b*' is provided. In apparatus 1*c* the switch function is not enabled and therefore one lock plate may be left out from the structure of the apparatus 1*c*. As already illustrated in FIG. 3B the conical part 24 presses towards a locking portion 13*b*' in the direction of the arrow 29', when the signal plug 7 is connected. When only one lock plate **12*b*' is provided, the switch function may not be needed in the apparatus 1*c*. FIG. 4 is an example illustration of the apparatus 1*a* with the signal plug 7 inserted and without the housing 2. FIG. 4 clearly illustrates how the electric contacts 6*a*, 6*b*, 6*c* and the lock plates 12*a*, 12*b* connect to the signal plug 7. Each electric contact 6*a*, 6*b*, 6*c* is configured to be in contact with the signal plug 7, and the electric contacts 6*a*, 6*b*, 6*c* may transmit signals to the signal plug 7 or may receive signals from the signal plug 7 when the signal plug 7 is received into the cavity 3**. The signals may comprise, for example, a mono audio signal or a stereo audio signal and/or a video signal.

In one example, the connections between the signal plug 7 and the apparatus **1*a*** are configured as follows:

a first contact surface **14*a*** is the "microphone"

a second contact surface **14*b*** is the "ground"

a third contact surface **14*c*** is the "right channel"

a fourth contact surface **14*d*** is the "left channel" and the "switch".

In this example, the first electric contact **6*a* connects to the first electric contact surface 14*a*, the second electric contact 6*b* connects to the second contact surface 14*b*, the third electric contact 6*c* connects to the third contact surface 14*c*, and the lock plates 12*a*, 12*b* connect to the fourth contact surface 14*d*. When the lock plates 12*a*, 12*b*** also function as a signal transmitter, no separate contact is needed for providing the "switch" function.

Figure 5:
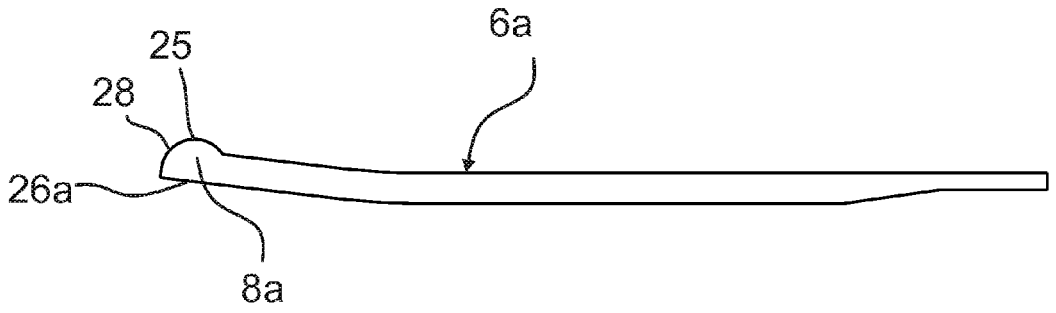
FIG. 5 is an example illustration of an electric contact.

FIG. 5 is an example illustration of an electric contact **6*a*. The electric contact 6*a* and an edge 8*a* of the electric contact 6*a* may be manufactured by metal stamping. A round surface 28 of the edge 8*a* may comprise a contact point 25. The contact point of the electric contact 6*a* connects to the contact surface 14*a* illustrated in FIG. 4. All electric contacts in the apparatus may be identical, with the exception that each electric contact has a unique length. The electric contact 6*a*** may be made out of metal.

Figure 6:
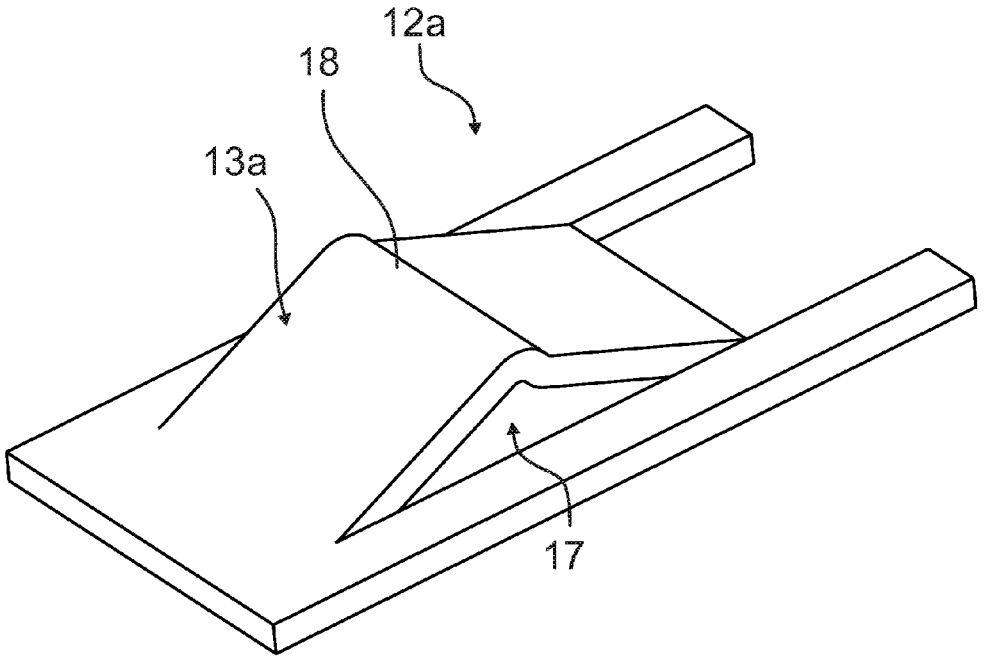
FIG. 6 is an example illustration of a lock plate.

FIG. 6 is an example illustration of a lock plate **12*a*. The lock plate 12*a* may be manufactured by metal stamping. In this example, a locking portion 13*a* of the lock plate 12*a* is structured to have a triangular profile 17. When a tip 18 of the triangular profile 17 is pressed downwards, the lock plate 12*a* flattens. The lock plate 12*a*** may be made out of metal.

Figure 7A:
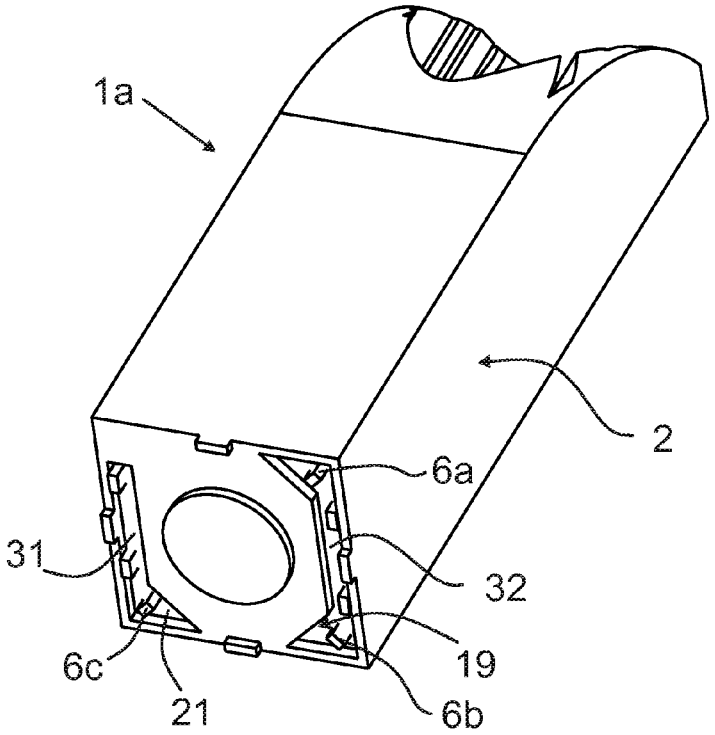
FIG. 7A is an example illustration of an apparatus from the back side of the apparatus.

FIG. 7A is an example illustration of an apparatus **1*a* showing the back side of the apparatus. The electric contacts 6*a*, 6*b*, 6*c* extend through a bottom 19 of the housing 2. The bottom comprises openings 31, 32, through which each electric contact 6*a*, 6*b*, 6*c* is led. In this way, it is possible to transmit the signals from the electric contacts 6*a*, 6*b*, 6*c* further to an electronic device. On the bottom 19, an insulating gasket 21 can be provided when the housing has to be waterproof. With the insulating gasket 21 and with the closed structure of the housing 2, it is possible to make the housing 2 insulated and thereby waterproof. The insulating gasket 21 may be manufactured with ultra violet (UV) resin potting. At the same time, the insulating gasket 21 may fix the electric contacts 6*a*, 6*b*, 6*c*** firmly in place. Ultraviolet potting materials cure in a tack free manner in seconds upon exposure to UV/visible light. Each potting compound is designed to bond different substrates, offering tenacious adhesion to plastics and metals. UV potting compounds are ideal for shallow component potting and typically used for sealing of connectors, inductors, detectors, capacitors, relay screws, sensors, etc.

Figure 7B:
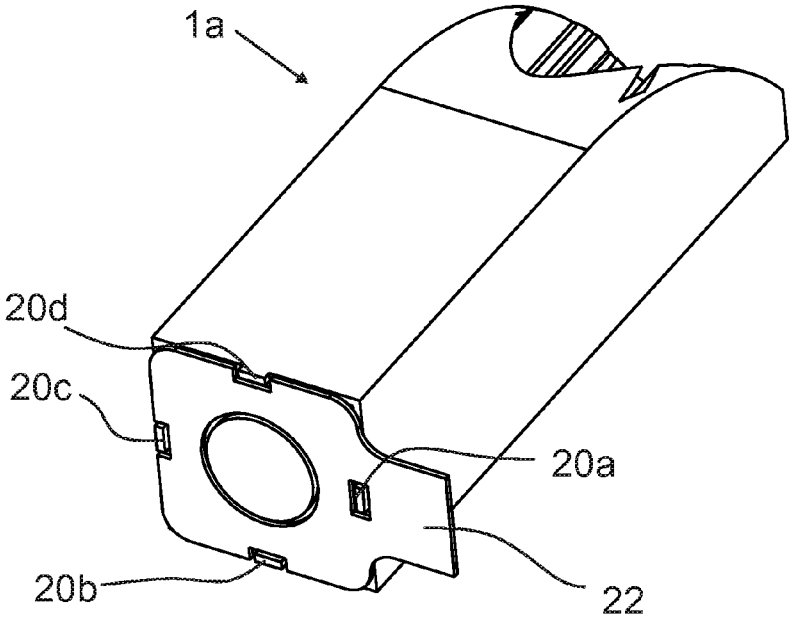
FIG. 7B is an example illustration of an apparatus, where a connecting circuitry is connected.

FIG. 7B is an example illustration of an apparatus **1*a* having a connecting circuitry 22. The connecting circuitry 22 may be mounted on the bottom 19 or on top of the insulating gasket 21. The connecting circuitry 22 may be, for example, a flexible printed circuit board, which is widely used in the electronic devices. Each electric contact 6*a*, 6*b*, 6*c* is in contact with the connecting circuitry 22 for transmitting signals outside the apparatus 1*a*, for example to an external apparatus which is configured to receive the signals. The connecting circuitry 22 collects the signals from the electric contacts 6*a*, 6*b*, 6*c*** and leads them, for example, further to a connecting circuit of an electronic device.

Figure 8:
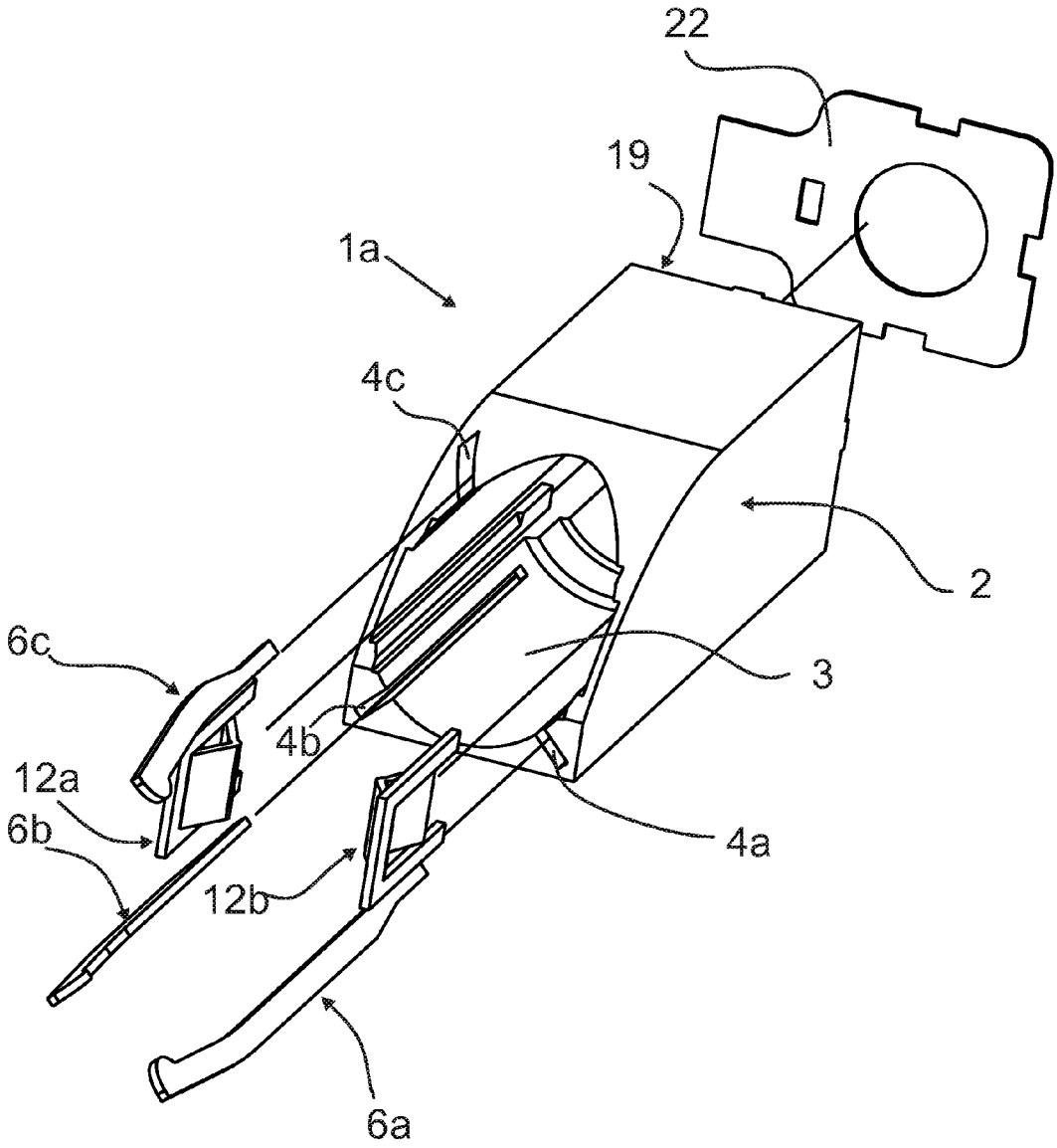
FIG. 8 is an explosive view of an example of an apparatus.

FIG. 8 is an explosive view of an example of an apparatus **1*a*. The explosive view illustrates how the apparatus 1*a* is assembled. In this example, the apparatus is manufactured by inserting the electric contacts 6*a*, 6*b*, 6*c* into the longitudinal grooves 4*a*, 4*b*, 4*c* via the open end of the cavity 3. The connecting circuitry 22 is connected to the bottom 19 with shoulders 20*a*, 20*b*, 20*c*, 20*d*. In another example, the electric contacts 6*a*, 6*b*, 6*c* may be inserted via the bottom 19 (not illustrated in FIG. 8) into the longitudinal grooves 4*a*, 4*b*, 4*c*. In this solution the housing 2** may be manufactured from two or more pieces.

Figure 9A:
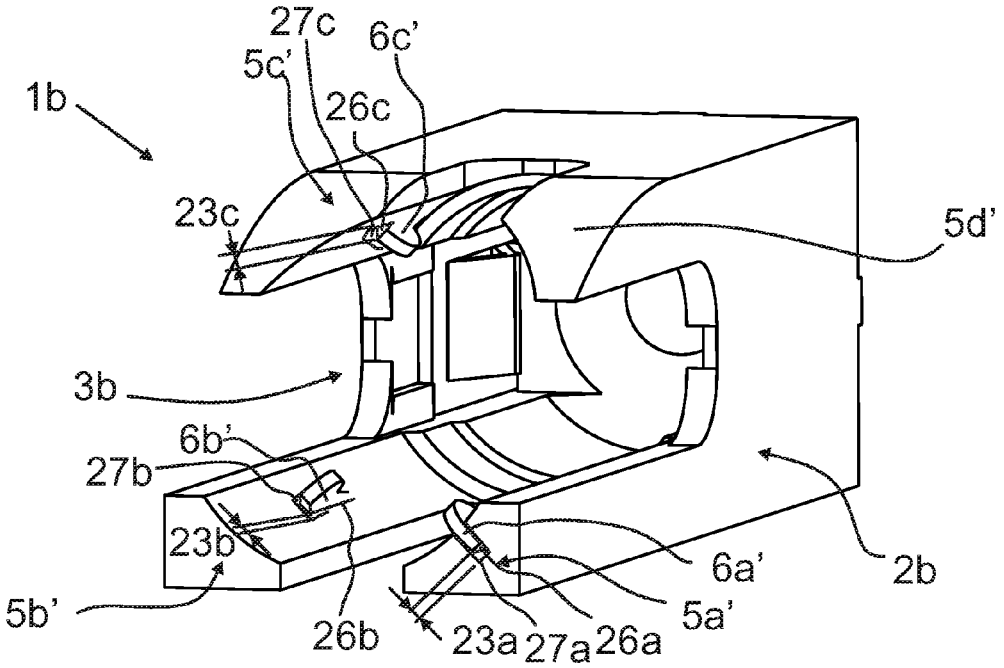
FIG. 9A is an example illustration of an apparatus.

FIG. 9A is an example illustration of an apparatus **1*b*. The apparatus 1*b* represents a non-waterproof solution. Therefore, the structure of a housing 2*b* of the apparatus 1*b* may be more open compared to the structure of the apparatus 1*a* illustrated in the above examples. The apparatus 1*b* in FIG. 9A does not comprise similar longitudinal grooves 4*a*, 4*b*, 4*c* as was illustrated in the above examples relating to the apparatus 1*a*. The housing 2*b* comprises a cavity 3*b* and at least two corner portions 5*a*', 5*b*', 5*c*' around the cavity 3*b*. Further, the apparatus 1*b* comprises an electric contact 6*a*', 6*b*', 6*c*' associated with each corner portion 5*a*', 5*b*', 5*c*'. Each electric contact 6*a*', 6*b*', 6*c*' is at least partially contained inside the corner portion 5*a*', 5*b*', 5*c*'. In FIG. 9A, the apparatus 1*b* comprises four corner portions 5*a*', 5*b*', 5*c*', 5*d*'. Corner portion 5*a*', 5*b*' and 5*c*' comprise corresponding electric contacts 6*a*', 6*b*', 6*c*'. In other words, one electric contact is located in each corner portion 5*a*', 5*b*', 5*c*'. The electric contacts 6*a*', 6*b*', 6*c*' may be already placed inside the mold when the housing 2*b* is manufactured, and thereby the electric contacts 6*a*', 6*b*', 6*c*' are partially inside the housing. One suitable manufacturing method for manufacturing the housing 2*b* is insert molding. Spaces 23*a*, 23*b*, 23*c* may be left between the electric contacts 6*a*', 6*b*', 6*c*' and the housing 2*b* to leave room for the electronic contacts to bend and move. Each space 23*a*, 23*b*, 23*c* may be located between a side 26*a*, 26*b*, 26*c* of each electric contact 6*a*', 6*b*', 6*c*' and a slot 27*a*, 27*b*, 27*c* in each corner portion 5*a*', 5*b*', 5*c*'. The spaces 23*a*, 23*b*, 23*c* and the slots 27*a*, 27*b*, 27*c* may be formed in the housing 2*b* when the housing 2*b*** is manufactured.

Figure 9B:
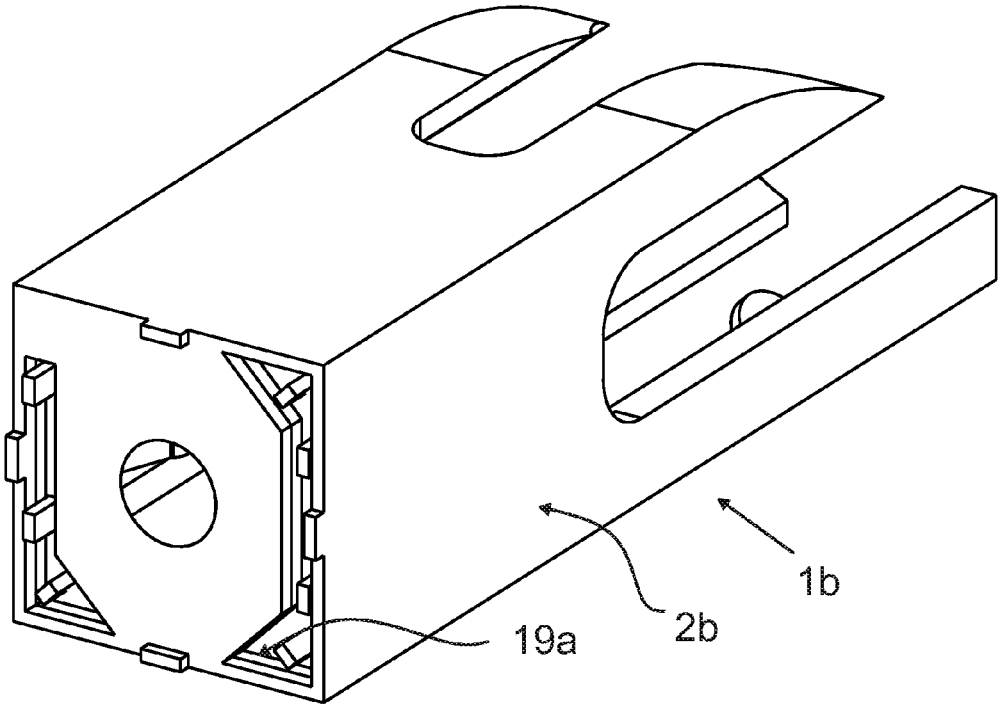
FIG. 9B is a back view illustration of an apparatus.

FIG. 9B is a back view illustration of an apparatus **1*b*. A bottom 19*a* of the housing 2*b* may be left open and no insulating gasket is needed for the apparatus 1*b***.

In one or more of the above examples, the electric contacts **6*a*, 6*b*, 6*c* of the apparatus 1*a*, 1*b*, 1*c* are arranged in the longitudinal grooves 4*a*, 4*b*, 4*c*, which are placed in separate corner portions 5*a*, 5*b*, 5*c*, 5*d* of the housing 2, 2*b*. This feature enables a reduction in the width of the apparatus 1*a*, 1*b*, 1*c*. By placing the electric contacts 6*a*, 6*b*, 6*c* in the separate corner portions 5*a*, 5*b*, 5*c* of the housing and by using metal stamping for manufacturing the electric contacts 6*a*, 6*b*, 6*c*, the required space for the electric contacts 6*a*, 6*b*, 6*c* may be minimized and thereby the reduction of the width can be accomplished. The width of the apparatus 1*a*, 1*b*, 1*c* may be for example 3.9 mm. Further, the apparatus 1*a*, 1*b*, 1*c* has a simple and reliable structure. Simple and well known manufacturing methods may be used to manufacture the apparatus 1***a*, 1*b*, 1*c*. Further, the apparatus 1*a*, 1*b*, 1*c* may be manufactured to be waterproof or alternatively non-waterproof, having a more open structure.

Metal stamping can be highly automated, making the manufacturing process well-suited for high-volume, because labor costs drop as the production levels rise. 3D-models of the attendant manufactured part may be easily implemented for manufacturing purposes. Efficient material use is a key advantage when manufacturing very small parts from expensive metals. Stamping is more cost efficient (per piece part) than machining, because stamping generates significantly less scrap than removing material by milling or grinding. By manufacturing the electric contacts 6*a*, 6*b*, 6*c* only with metal stamping, no bending phase is needed in the manufacturing process. This may decrease the manufacturing costs and make the manufacturing process less complicated.

The apparatus 1*a*, 1*b*, 1*c* disclosed in the examples above is useful in a solution where the apparatus 1*a*, 1*b*, 1*c* is used as an audio/video jack for an electronic communication device, such as a smart phone or a tablet. The apparatus 1*a*, 1*b*, is particularly useful when the electronic communication device utilizes the 3.5 mm audio/video plug. One useful location to place the apparatus 1*a*, 1*b* is in a corner or a side portion of the electronic communication device. The rounding of the housing 2, 2*b* may be designed according to the housing of the electronic communication device in order to accomplish good appearance, or the rounding may be left out from the housing 2, 2*b* completely.

Although FIGS. 1A-9B describe the apparatus 1*a*, 1*b*, 1*c* operating with audio and/or video signals, the apparatus 1*a*, 1*b*, 1*c* may be used also for other types of signals additionally or alternatively.

An embodiment of an apparatus comprises a housing comprising: a circular cavity; and at least two longitudinal grooves placed in separate corner portions of the housing and around the circular cavity; and an electric contact associated with each longitudinal groove of the at least two longitudinal grooves.

In one example, the apparatus comprises a locking mechanism configured to lock a signal plug within the cavity.

In one example, the locking mechanism comprises at least one lock plate in an inner end portion of the cavity.

In one example, the locking mechanism comprises at least two lock plates opposing each other in an inner end portion of the cavity, wherein the at least two lock plates comprise a locking portion configured to be compressed when a conical part of a signal plug is pressed towards the locking portion.

In one example, the at least two longitudinal grooves are structured to open into the circular cavity.

In one example, each longitudinal groove is placed at least partially on the diagonal or in immediate vicinity of the diagonal of the transversal cross-section of the housing.

In one example, each electric contact is individually integrated into its associated longitudinal groove.

In one example, the apparatus is structured to releasably receive a signal plug within the cavity, wherein each electric contact is configured to be in contact with the signal plug when the signal plug is received into the cavity.

In one example, each electric contact is configured to be in contact with a signal plug or an audio/video plug when the signal plug is received into the cavity.

In one example, each electric contact is structured to function as a spring which presses towards a contact surface of the signal plug, when the signal plug is received into the cavity.

In one example, the electric contact comprises an edge for connecting with a signal plug, wherein the electric contact and the edge are manufactured by metal stamping.

In one example, the housing comprises a bottom configured to receive the electric contacts through openings in the bottom, wherein each electric contact is fixed in place with an insulating gasket applied to the bottom and thereby insulating the bottom and the housing.

In one example, the housing comprises a bottom to which the electric contacts are fixed.

In one example, the bottom is insulated with an insulating gasket.

In one example, the bottom is insulated with ultraviolet resin potting.

In one example, the housing is insulated.

In one example, the transversal cross-section of the housing is structured to be substantially rectangular.

In one example, the apparatus comprises a connecting circuitry installed in the bottom of the housing, wherein each electric contact is in contact with the connecting circuitry.

In one example, the apparatus is an audio/video jack.

In one example, the apparatus is an audio/video jack of an electronic communication device.

In one example, an electronic device comprises the apparatus.

In one example, the apparatus further comprises an electronic device, the electronic device comprising the housing and the electric contacts.

A manufacturing method is disclosed for an apparatus comprising a housing comprising a circular cavity having an open end; and at least two longitudinal grooves placed in separate corner portions of the housing and around the circular cavity, and an electric contact associated with each longitudinal groove, wherein the apparatus is manufactured by inserting the electric contacts into the longitudinal grooves via the open end of the cavity.

One example comprises applying an insulating gasket to a bottom of the housing, thereby fixing each electric contact at least partially in place and insulating the housing.

In one example comprises manufacturing the insulating gasket with ultraviolet resin potting.

An embodiment of an apparatus comprises a housing comprising: a cavity; and at least two corner portions of the housing and around the cavity; and an electric contact associated with each corner portion of the at least two corner portions, wherein each electric contact is at least partially inside the corner portion.

In one example, the housing of the apparatus is manufactured with insert molding.

In one example, the housing of the apparatus comprises a rounded corner.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages.

Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example may also be connected in any combination to any other example.

The invention claimed is:

1. An apparatus comprising: a housing comprising: a circular cavity;

at least two longitudinal grooves disposed in separate corner portions of the housing at least partially on the diagonal or in immediate vicinity of the diagonal of a transversal cross-section of the housing, and structured to open into the circular cavity; and at least two electric contacts associated with the at least two longitudinal grooves, each said electric contact disposed along each said longitudinal groove such that the electric contact is at least partially contained inside a corner portion of the longitudinal groove and at least partially extends into the circular cavity in a direction of the diagonal of the transversal cross-section of the housing.

2. The apparatus according to claim 1, wherein the apparatus comprises a locking mechanism configured to lock a signal plug within the cavity.

3. The apparatus according to claim 2, wherein the locking mechanism comprises at least one lock plate in an inner end portion of the circular cavity.

4. The apparatus according to claim 3, wherein the locking mechanism comprises at least two lock plates opposing each other in the inner end portion of the circular cavity, wherein the at least two lock plates comprise a locking portion configured to be compressed when a conical part of a signal plug is pressed towards the locking portion.

5. The apparatus according to claim 1, wherein the at least two electric contacts have different lengths.

6. The apparatus according to claim 1, wherein responsive to a signal plug entering the circular cavity, the at least two electric contacts move away from the signal plug into the respective longitudinal grooves in the direction of the diagonal of the transversal cross-section of the housing.

7. The apparatus according to claim 1, wherein the at least two electric contacts are individually integrated into their associated longitudinal grooves.

8. The apparatus according to claim 1, wherein the apparatus is structured to releasably receive a signal plug within the circular cavity, wherein the at least two electric contacts are configured to be in contact with the signal plug when the signal plug is received into the circular cavity.

9. The apparatus according to claim 1, wherein the at least two electric contacts are structured to function as a spring which presses towards a contact surface of the signal plug in response to the signal plug being received into the circular cavity.

10. The apparatus according to claim 1, wherein the electric contact comprises an edge for connecting with a signal plug, wherein the electric contact and the edge are manufactured by metal stamping.

11. The apparatus according to claim 1, wherein the housing comprises a bottom configured to receive the at least two electric contacts through openings in the bottom, wherein an individual electric contact is fixed in place with an insulating gasket applied to the bottom and thereby insulating the bottom and the housing.

12. The apparatus according to claim 1, wherein the transversal cross-section of the housing is structured to be substantially rectangular.

13. The apparatus according to claim 1, comprising a connecting circuitry installed in the bottom of the housing, wherein the at least two electric contacts are in contact with the connecting circuitry.

14. The apparatus according to claim 1, wherein the apparatus is an audio/video jack.

15. The apparatus according to claim 1, further comprising an electronic device, the electronic device comprising the housing and the at least two electric contacts.

16. A method for manufacturing an apparatus comprising:

providing a housing comprising a circular cavity having an open end;

disposing at least two longitudinal grooves placed in separate corner portions of the housing and around the circular cavity at least partially on the diagonal or in immediate vicinity of the diagonal of a transversal cross-section of the housing, and structured to open into the circular cavity; and associating at least two electric contacts with the at least two longitudinal grooves, wherein the apparatus is manufactured by inserting the at least two electric contacts into the at least two longitudinal grooves via the open end of the circular cavity.

17. The method according to claim 16, further comprising:

applying an insulating gasket to a bottom of the housing, thereby fixing the at least two electric contacts at least partially in place and insulating the housing.

18. The method according to claim 17, further comprising: manufacturing the insulating gasket with ultraviolet resin potting.

19. An apparatus comprising: a housing comprising: a cavity;

at least three longitudinal grooves disposed along a diagonal direction of a transverse cross-section of the cavity at corner portions of the housing around the cavity; and at least three electric contacts associated with the at least three longitudinal grooves, each said electric contact disposed partially inside each said longitudinal groove at a corner portion and partially outside the longitudinal groove in a direction that extends into the cavity.

20. The apparatus according to claim 19, wherein the housing comprises a rounded edge.

* * * * *